United States Patent [19]

Kane et al.

[11] 4,052,575

[45] Oct. 4, 1977

[54] METAL-CLAD GAS-TYPE HIGH-POWER CIRCUIT-BREAKER CONSTRUCTIONS INVOLVING TWO ARC-EXTINGUISHING ASSEMBLAGES

[75] Inventors: Richard E. Kane, Monroeville, Pa.; Frank L. Reese, deceased, late of Monroeville, Pa., by Blanche C. Reese, executrix, Lansford, Pa.

[73] Assignee: Westinghouse Electric Corporation, Pittsburgh, Pa.

[21] Appl. No.: 575,103

[22] Filed: May 6, 1975

[51] Int. Cl.[2] ..... H01H 33/28

[52] U.S. Cl. ..... 200/145; 200/148 D

[58] Field of Search ..... 200/144 AP, 145, 146 R, 200/146 AA, 148 R, 148 D, 148 E, 148 F

[56] References Cited

U.S. PATENT DOCUMENTS

| | | | |
|---|---|---|---|
| 2,921,168 | 1/1960 | Forwald | 200/145 |
| 3,235,774 | 2/1966 | Frowein | 200/145 |
| 3,743,804 | 7/1973 | Frowein | 200/145 |

*Primary Examiner*—Gerald P. Tolin
*Attorney, Agent, or Firm*—W. R. Crout

[57] ABSTRACT

An improved metal-clad gas-type high-power circuit-breaker construction is provided involving two upstanding circuit-breaker assemblages electrically interconnected adjacent their upper ends, and connected into the series line transmission circuit, preferably, adjacent the mid-portions thereof to pressurized laterally-extending power-transmission lines.

Improved structure is provided for simultaneously supporting the interrupting modules, or units up in the air interiorly of an outer grounded metallic casing structure, and, additionally, providing a high-pressure gas-conduit path to the pressurized insulating casing structure surrounding the circuit-breaker modules, and spaced inwardly from the outer grounded metallic casing structure.

Improved means are provided for increasing the electrical power capable of being interrupted by such a structure, when desired, involving a series closing resistance, which is inserted into the circuit only during the closing operation of the interrupter. During the opening operation, the resistor is kept out of the electrical circuit and is not utilized.

The invention is also applicable when high-voltage surges are not contemplated by utilizing a different type of circuit-interrupter unit within each interrupting assemblage, namely, for example, a single-break circuit-interrupter unit, involving only a separable pair of contacts and gas flow passing through one or both of said separable contacts, depending upon the rating of the breaker, to extinguish the arc.

The invention moreover contemplates the arrangement of a pair of circuit-breaker assemblages disposed in generally-horizontal relationship, again the two circit-breaker assemblages constituting a single pole-unit, or one phase of a three-phase circuit-breaker structure. In such a horizontally-mounted arrangement, wherein instead of the two circuit-breaker assemblages extending up in the air, in this alternate embodiment of the invention, they are disposed relatively horizontally, with the connections again being made by, preferably, pressurized conductors, and, for example, the mechanism and gas-compressor equipment housing extending lengthwise, generally horizontally along one of the horizontally-arranged circuit-breaker assemblages of the structure.

13 Claims, 23 Drawing Figures

65
120
124
19
122
23
125
25

28
31
120
122
23
31

IMPROVED METAL-CLAD GAS-TYPE HIGH-POWER CIRCUIT-BREAKER CONSTRUCTIONS INVOLVING TWO ARC-EXTINGUISHING ASSEMBLAGES

CROSS-REFERENCES TO RELATED APPLICATIONS

Reference may be had to U.S. patent application filed Nov. 11, 1974, Ser. No. 522,960, now U.S. Pat. No. 4,006,332, issued February 1, 1977 to Ronald W. Crookston et al. Also, reference may be had to U.S. patent application filed Nov. 27, 1974, Ser. No. 527,931, now U.S. Pat. No. 4,005,345, issued Jan. 25, 1977 to Richard E. Kane and Charles LeRow, and U.S. patent application filed Nov. 27, 1974, Ser. No. 527,929, now U.S. Pat. 4,024,265, issued May 17, 1977 relating to the same general type of equipment. Also, see U.S. patent applications filed Nov. 19, 1974, Ser. No. 525,124, by Leroy et al, now U.S. Pat. No. 4,016,384, issued Apr. 5, 1977, and application filed Nov. 27, 1974, Ser. No. 527,930, by Leroy et al, now U.S. Pat. No. 4,013,853, issued Mar. 22, 1977, all of the aforesaid applications being assigned to the assignee of the instant patent application.

U.S. patent application filed Dec. 4, 1973 by Joseph Rostron, et al, Ser. No. 421,574, entitled "High-Voltage Circuit-Interrupter Having A Closing Resistance And Improved Shunting-Resistance Contacts Therefor", now U.S. Pat. No. 3,863,041, issued Jan. 28, 1975 relates to a closing-resistance arrangement, which inserts the closing resistance only during the closing operation of the circuit-interrupter, and keeps it out of the electrical circuit during the opening operation of the circuit interrupter.

BACKGROUND OF THE INVENTION

In recent years, there has come about a demand for a reduced-size substation, and this demand, on the part of public utilities, has been met by gas-insulated substation equipment, such as set forth in U.S. Pats. No. 3,378,731 — Whitehead, U.S. Pat. No. 3,348,001 — Upton et al, U.S. Pat. No. 3,801,768 — Meyer; U.S. Pat. No. 3,794,797 — Spindle et al; U.S. Pat. No. 3,356,798 — McKinnon; U.s. Pat. No. 3,610,858 — Gruber et al; U.S. Pat. No. 3,599,041 — Boersma et al; and U.S. Pat. No. 3,562,460 — Koener.

The foregoing equipment significantly reduces the space required by the high-voltage side of substations rated, for example, 115 K.V. through 345 K.V. The space reduction is accomplished by replacing the open bus and air-type terminal bushings with gas-insulated bus, filled, for example, with a highly-insulating gas, such as sulfur-hexafluoride ($SF_6$) gas, at a pressure say, for example, 45 p.s.i.g., and thereby permitting the location of electrical equipment components very closely together. This gas-insulated substation equipment has many advantages, among which are:

1. Significant reduction in space requirements both in land area and overall height.
2. Added system reliability by eliminating the possibility of phase-to-phase faults, lightning strokes within the system, or contamination of insulators.
3. Reduced maintenance because the closed system is isolated from its environment.
4. Added personnel safely because all live parts are covered by grounded shields.
5. The gas-insulated modular approach has the additional advantage, because it provides the utility user with lower installation costs, when compared with conventional, or other types of power transmission systems.

The gas-insulated system, as briefly described above, has additional design strategies, inasmuch as the high-voltage power-transmission and control equipment is compacted so that both the space required, and the total length of bus is minimized. The power-transformers may be located on outside corners of the station so as to be capable of ready removal, and the location of cable potheads is flexible, with the result that the system may be readily connected to overhead lines.

As examples of the types of ratings for such gas-insulated transmission systems, reference may be made to the specification ratings, as set forth below:

| | |
|---|---|
| 115/138 k.v. Ratings | |
| General Ratings for MGT Systems | $SF_6$ at 45 psig |
| Rated maximum voltage | 145 |
| Bil | 650 |
| 60 HZ one minute withstand | 310 |
| Chopped wave | Not applicable |
| Symmetrical 3 Second Current Rating | 47 ka |
| Momentary Current | 76 ka |
| Switching Current Ratings | |
| Circuit breaker (maximum rated interrupting current) | 63 ka |
| Magnetizing current switch | 35 amps |
| Isolator | No load switching only |
| Ground switch | No load switching only |
| Continuous Current Ratings | |
| Circuit Breaker | 2,500 Amperes |
| Load-break switch | 2,500 Amperes |
| Magnetizing current switch | 2,500 Amperes |
| Isolator | 2,500 Amperes |
| Ground Switch | Not applicable |
| Bus | 3,000 Amperes |
| 230 k.v. Ratings | |
| General Ratings for MGT Systems | $SF_6$ at 45 p.s.i.g. |
| Rated maximum voltage | 242 |
| BIL | 900 |
| 60 HZ-one minute withstand | 425 |
| Chopped wave | Not applicable |
| Symmetrical 3 Second Current Rating | 47 ka |
| Momentary Current | 76 ka |
| Switching Current Ratings | |
| Circuit-breaker (maximum rated interrupting current) | 63 ka |
| Magnetizing current switch | 35 amps. |
| Isolator | No load switching only |
| Ground Switch | No load switching only |
| Continuous Current Ratings | |
| Circuit-breaker | 2,500 Amperes |
| Load-break switch | 2,500 Amperes |
| Magnetizing current switch | 2,500 Amperes |
| Isolator | 2,500 Amperes |
| Ground switch | Not applicable |
| Bus | 3,000 Amperes |
| 345 k.v. Ratings | |
| General Ratings for MGT Systems | $SF_6$ at 45 p.s.i.g. |
| Rated maximum voltage | 362 |
| Bil | 1050 |
| 60 HZ-one minute withstand | 555 |
| Chopped wave | Not applicable |
| Symmetrical 3 Second Current Rating | 47 ka |
| Momentary Current | 76 ka |
| Switching Current Ratings | |
| Circuit-breaker (maximum rated interrupting current) | 50 ka |
| Magnetizing current switch | 35 amps |
| Isolator | No load switching only |
| Ground Switch | No load switching only |
| Continuous Current Ratings | |
| Circuit-breaker | 2,500 Amperes |
| Load-break switch | 2,500 Amperes |
| Magnetizing current switch | 2,500 Amperes |
| Isolator | 2,500 Amperes |
| Ground Switch | Not applicable |
| Bus | 3,000 Amperes |

BRIEF SUMMARY OF THE INVENTION

According to the present invention, an improved high-power gas-type circuit-breaker construction is utilized involving a pair of upstanding circuit-breaker assemblages, which are electrically interconnected adjacent their upper ends by a power conductor disposed within a pressurized interconnecting compartment, each of the circuit-interrupting assemblages comprising an outer grounded metallic casing structure filled with a pressurized gas, and line connections being made to the two circuit-breaker modules by pressurized power-connectors extending laterally from the mid-portions of the upstanding casing structures.

Additionally, for supporting the upstanding circuit-interrupter modules disposed interiorly of the outer grounded casing structures, and, additionally, providing high-pressure gas to the pressurized casing structures, disposed interiorily of the outer metallic casing structures, are a pair of upstanding tubular gas-conducting support members, the latter being supported upon a lower rigid supporting base framework.

For high-power applications, where voltage surges are sought to be avoided during the closing operation of the circuit-interrupter, circuit-interrupter modules, or units with a closing resistance and resistance contacts may be provided. On the other hand, for relatively low-power ratings, circuit-interrupter modules, or units may be provided of the one or two-break variety, without such closing resistances being provided. The power ratings of the circuit-breaker and the voltage conditions encountered will, of couse, determine the necessity of using closing resistances in the particular circuit-breaker modules, or of not using them.

The invention moreover contemplates the arrangement of the two circuit-breaker assemblages arranged generally-horizontally, relatively close to ground potential, and also enclosed within outer grounded metallic casing structures. The gas and compressor equipment may be, for example, disposed within a cabinet structure arranged generally longitudinally, horizontally along one side of one of the two circuit-breaker assemblages.

DESCRIPTION OF THE PREFERRED EMBODIMENTS

Figure 2:
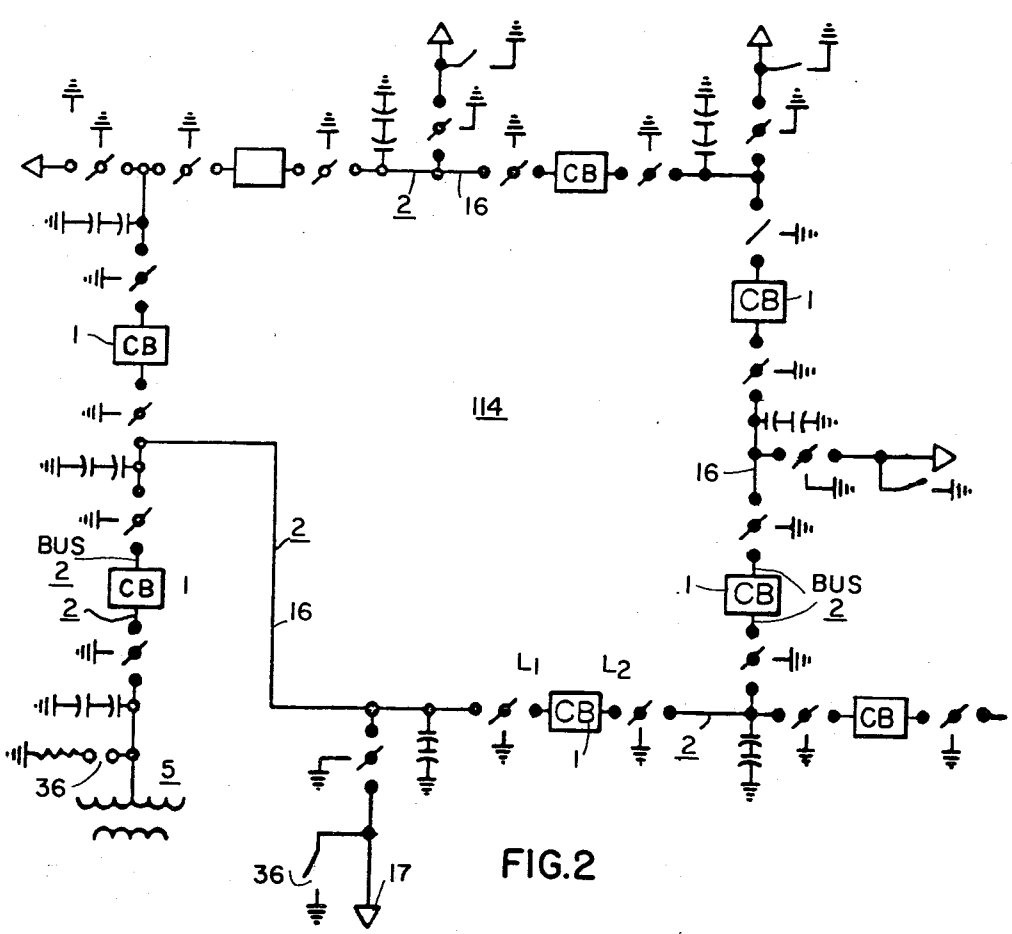
FIG. 2 is a one-line diagram for the gas-insulated substation power-transmission equipment of FIG. 1.
Figure 1:
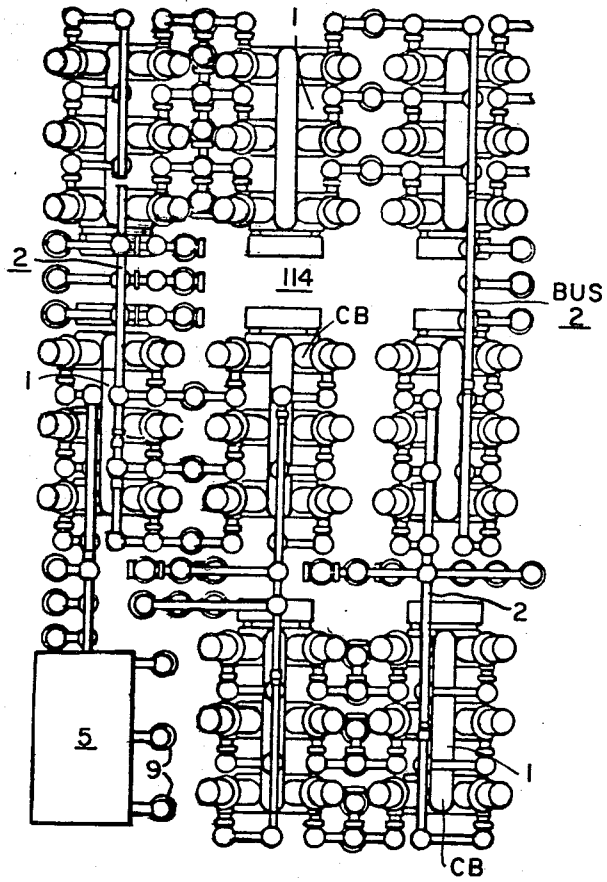
FIG. 1 is a somewhat diagrammatic view of gas-insulated substation equipment showing the general environment for one application of the improved circuit-breaker construction of the present invention.

The present invention has particular application to a line of equipment 114 involving the gas-insulated substations having gas-insulated components, and somewhat diagrammatically illustrated in FIGS. 1 and 2 of the drawings.

FIG. 2 is a one-line diagram of the equipment 114 illustrated in FIG. 1. It will be noted, from a consideration of FIGS. 1 and 2, that the high-voltage equipment 114 is arranged so that both the space required, and the total length of the gas-insulated bus 2 is minimized. The power transformer 5 is located on an outside corner of the station, preferably, so that it can be easily removed. The gas-insulated bus 2 is attached directly to the transformer-bushing minimizing area and height required. The location of the cable pothead 17 is flexible. In the gas-insulated system 114, as illustrated in FIGS. 1 and 2, it is chosen to minimize the length of the $SF_6$ bus 2. If a lightning arrester 36 is located at each pothead 17, an arrester 36 is not required at the lower-transformer 5

It will be noted that the gas-insulated system 114 of FIG. 1 can be connected to overhead lines. However, the air clearances, required by incoming power lines, will somewhat enlarge the total area required by the system 114, and will require additional $SF_6$ bus 2.

The gas-insulated transmission system 114, illustrated in FIGS. 1 and 2 is a line of equipment, which will significantly reduce the space required by the high-voltage side of substations rated 115 K.V. The space reduction is accomplished by replacing the open bus and air terminal-bushings, commonly used, with gas-insulated bus 2 filled with sulfur-hexafluoride ($SF_6$) gas 8, for example, at 45 psig (at 70° F.), and moving the component parts of the electrical equipment as close together as possible.

The use of gas-insulated transmission systems 114 offers many advantages. The use of the system 114 offers several advantages to the utility user, some of these are:

1. Significant reduction in space requirements both in land area and overall height.
2. Added system reliability by eliminating the possibility of phase-to-phase faults, lightning strokes within the system 114, or contamination of the environment.
3. Reduced maintenance because the closed system 114 is isolated from its environment.
4. Added personnel safety because all live parts are covered by grounded shields.
5. The modular approach was chosen because it could provide the utility user with lower installation costs when compared with conventional or other gas-insulated systems.
6. The system 114 can be overbuilt to permit multiple use of the land.

Generally, the equipment 114 includes a plurality of bus assemblies 2 determined by the length that can generally be shipped. The typical bus length 2 will be, for example, 40 feet, and may consist of two 20 feet lengths, with an epoxy spacer 2a (FIG. 3) in each length 2. The ends of the bus 2 can be connected to additional lengths of bus 2, or any functional member of the system 114. Expansion joints are located in each 20 foot bus-section 2 to absorb the maximum of 0.4 inches of expansion expected. As stated, sulfur-hexafluoride ($SF_6$) gas 8 at 45 psig, for example, fills both the sheat 37 and the bus conductor 2, and is free to move throughout the entire bus 2. The 45 psig $SF_6$ gas pressure provides approximately the highest dielectric strength possible down to −40° C. without liquefaction, eliminating the need for auxiliary heat. High-pressure $SF_6$ gas, however, does require a heat input at low ambient temperatures.

Figure 3:
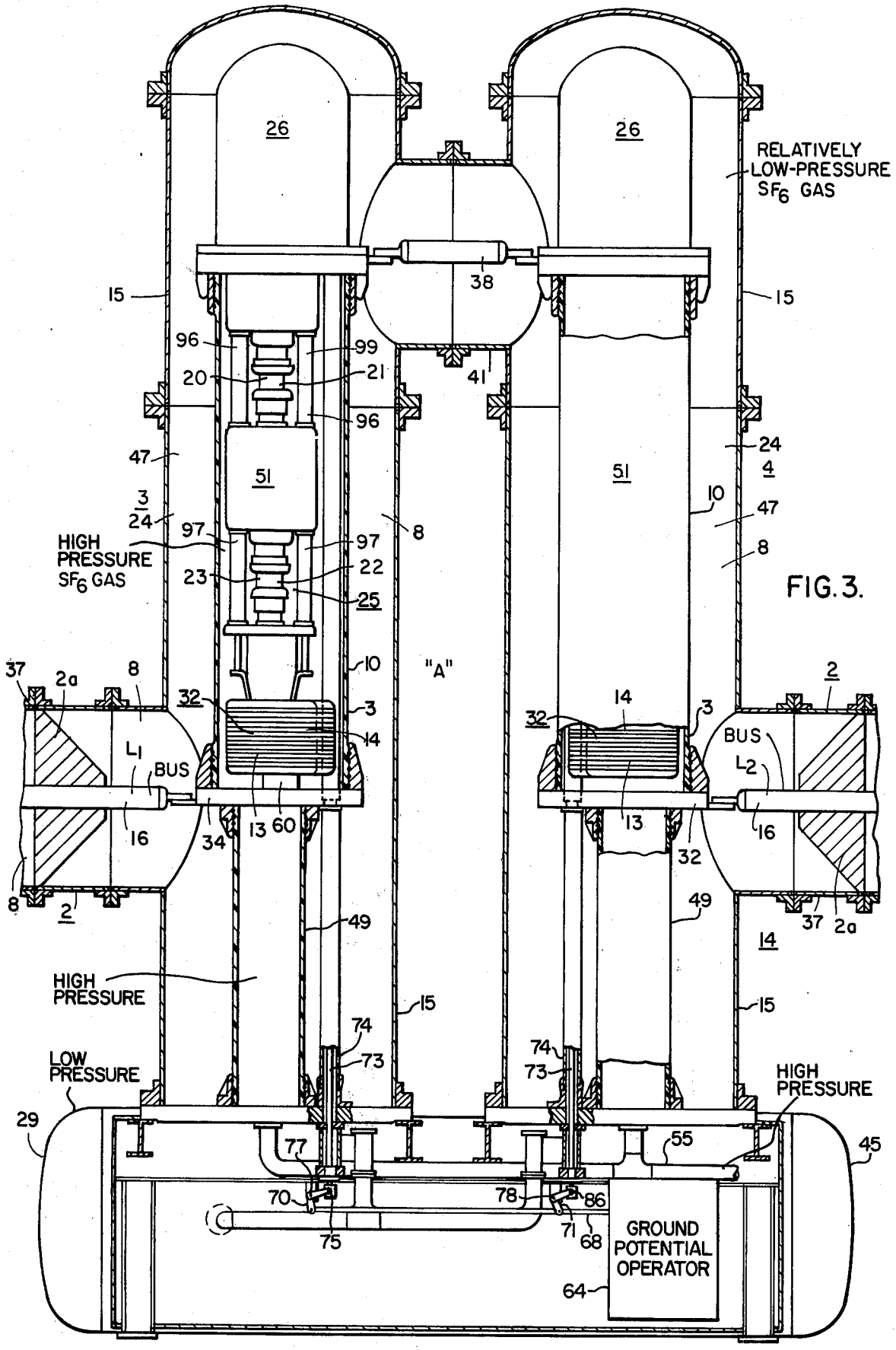
FIG. 3 is an enlarged vertical sectional view taken through the improved circuit-breaker installation of the present invention, the contacts being illustrated in the closed-circuit position.

With reference to FIG. 3 of the drawings, it will be observed that there are provided two upstanding circuit-breaker assemblages 3 and 4, each including an outer metallic grounded casing structure 15, and an interiorly-disposed insulating high-pressure casing structure 10. A conductor 38, disposed within a horizontally-disposed grounded metallic gas-filled conduit 41, electrically interconnects the two circuit-breaker assemblages 3, 4 in electrical series relationship.

The interiorly-disposed insulating casing structure 10 is positioned radially inwardly from the outer metallic grounded casing structure 15 and has an insulating gas 8, such as sulfur-hexafluoride ($SF_6$) gas, for examople there-between in the annular space 47, at a pressure, say, for example, 45 psig.

Disposed interiorly of the inner insulating pressurized casing structure 10 is a circuit-interrupter module 51, adaptable for relatively high ratings, and including two interrupting breaks 21, 22 and, additionally, a resistance break 13. The resistance break 13 is surrounded by a shunting closing resistance 14, such as set forth in detail in U.S. patent application filed Dec. 4, 1973 Ser. No. 421,574, now U.S. Pat. No. 3,863,041, issued Jan. 28, 1975, and assigned to the assignee of the instant patent application.

Disposed at the upper end of the circuit-breaker module 51 is a mechanism compartment 26 enclosing a control valve and an operating piston, not shown, which controls the opening and closing operations of a pair of movable interrupting contacts 20 and 23, and also the operation of a lower-disposed movable resistance contact 11.

Various details of the operating structure may be obtained from a reading of U.S. Pat. No. 3,596,028, and the patents therein referred to. However, for an understanding of the present invention, it is merely necessary to know that each upstanding column structure 3, 4 contains two main arc-extinguishing units 6 and 7 together with a lower resistance unit 9, which has the resistance contacts 11, 12 thereof controlled in such a manner that during the closing operation of the interrupter 3, the closing resistance 14 is inserted serially into the circuit to damp any high-voltage surges occurring on the line 16 (FIG. 3). However, as will be obvious, in the fully closed-circuit position of the interrupter 3, it is desirable to shunt, or to take the resistance 14 out of the circuit, due to heating effects and energy losses, and the function of the separable closing contacts 11, 12 is to achieve this end.

During the opening operation, on the other hand, it is desirable to have the resistance 14, which serves only a closing function, completely out of the circuit 16 during the opening operation. As a result, the closing resistance 14 is shunted out of the circuit 16 during the initial portion of the opening operation, where the task of interrupting the arcs 18, 19 (FIG. 5) is imposed only on the main contact structures 31, 22, and not at the resistance-contact structure 11, 12. In the particular embodiment under discussion, and as illustrated in FIGS. 3–10 there are provided two main contact structures 21, 22 and a lower serially-related resistance contact structure 11, 12, on each column structure 3, 4, such as illustrated in FIG. 3. Reference may be made to the diagrammatic view of FIG. 7 for an indication of the fact that there are provided six breaks through the entire transmission line circuit 16 from $L_1$, through the two main contact structures 21 and 22 of the left-hand column 3, through the lower resistance contact structure 11, 12 of the left-hand column 3, upper conductor 38, and through the right-hand column structure 4, in a similar manner, to the lower line terminal $L_2$ of the interrupter 4.

With further reference directed to FIG. 3 of the drawings, it will be observed that there are provided two identical interrupting assemblages 3 and 4 spaced away from each other, as illustrated in FIG. 3, and each of which contains two serially-related main contact assemblages 21, 22, together with a serially-related separable resistance contact assemblage 13, which controls the insertion of the closing resistance 14.

Figure 4A:
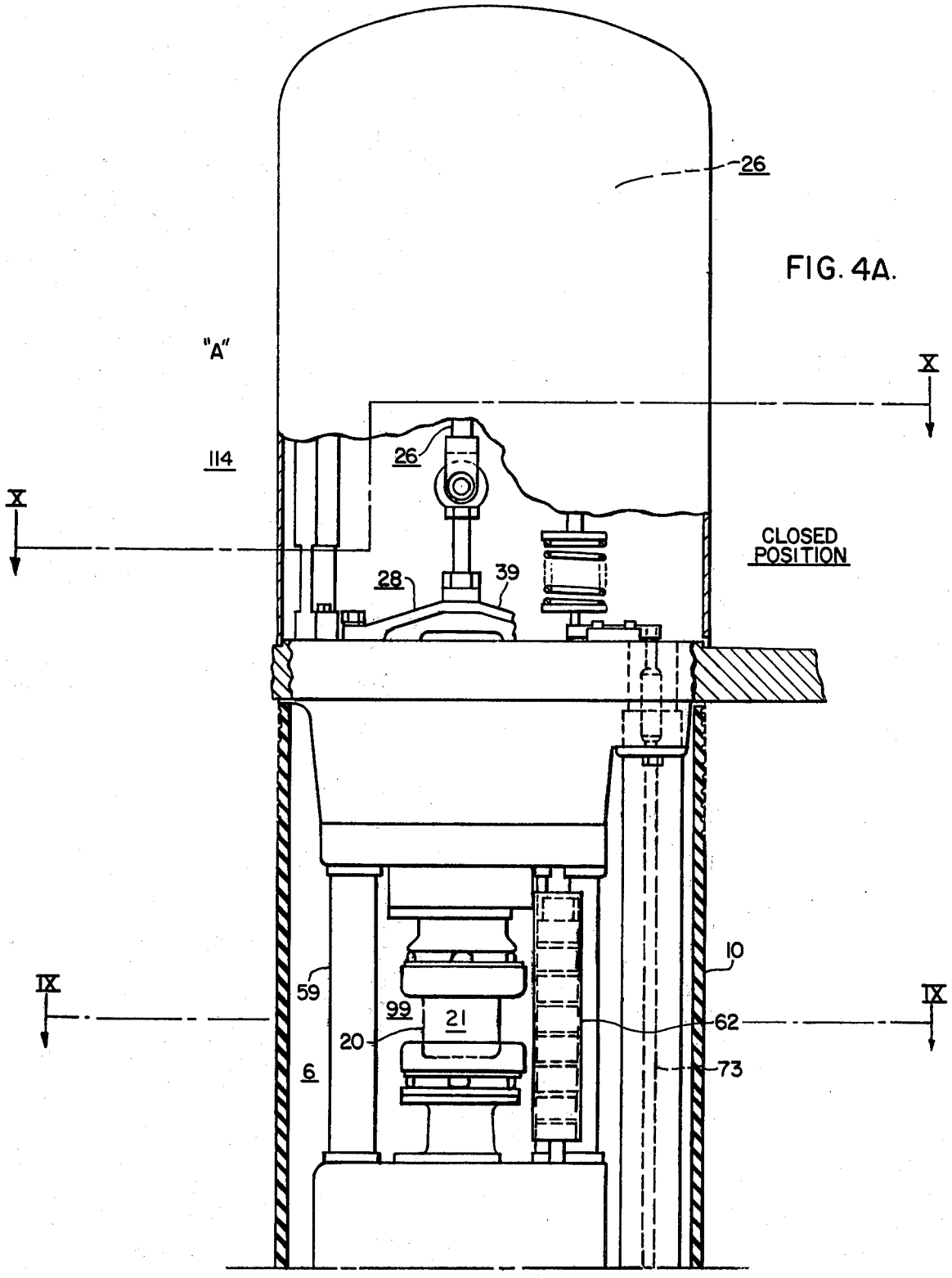
FIG. 4A is an enlarged side-elevational view, partially in vertical section, of the upper main arc-extinguishing unit of one-half of a pole-unit, or phase unit of the breaker, the contact structure being illustrated in the closed-circuit position.
Figure 4B:
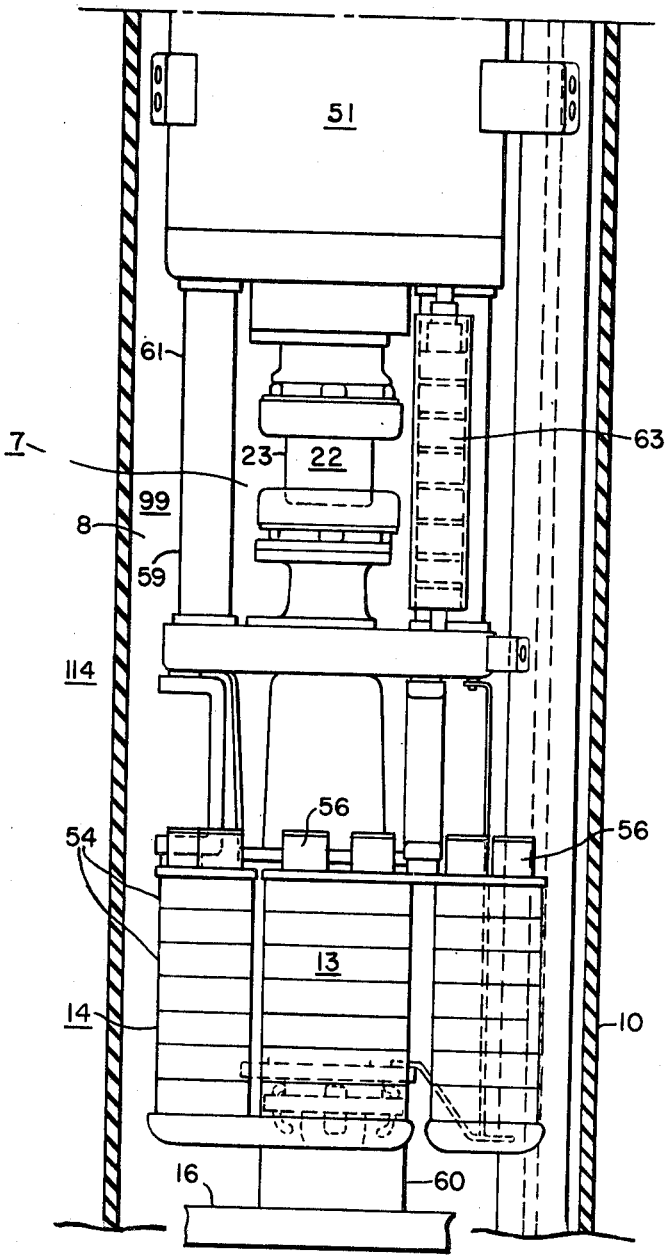
FIG. 4B shows the lower portion of the breaker of FIG. 4A, again the contacts being shown closed.
Figure 8:
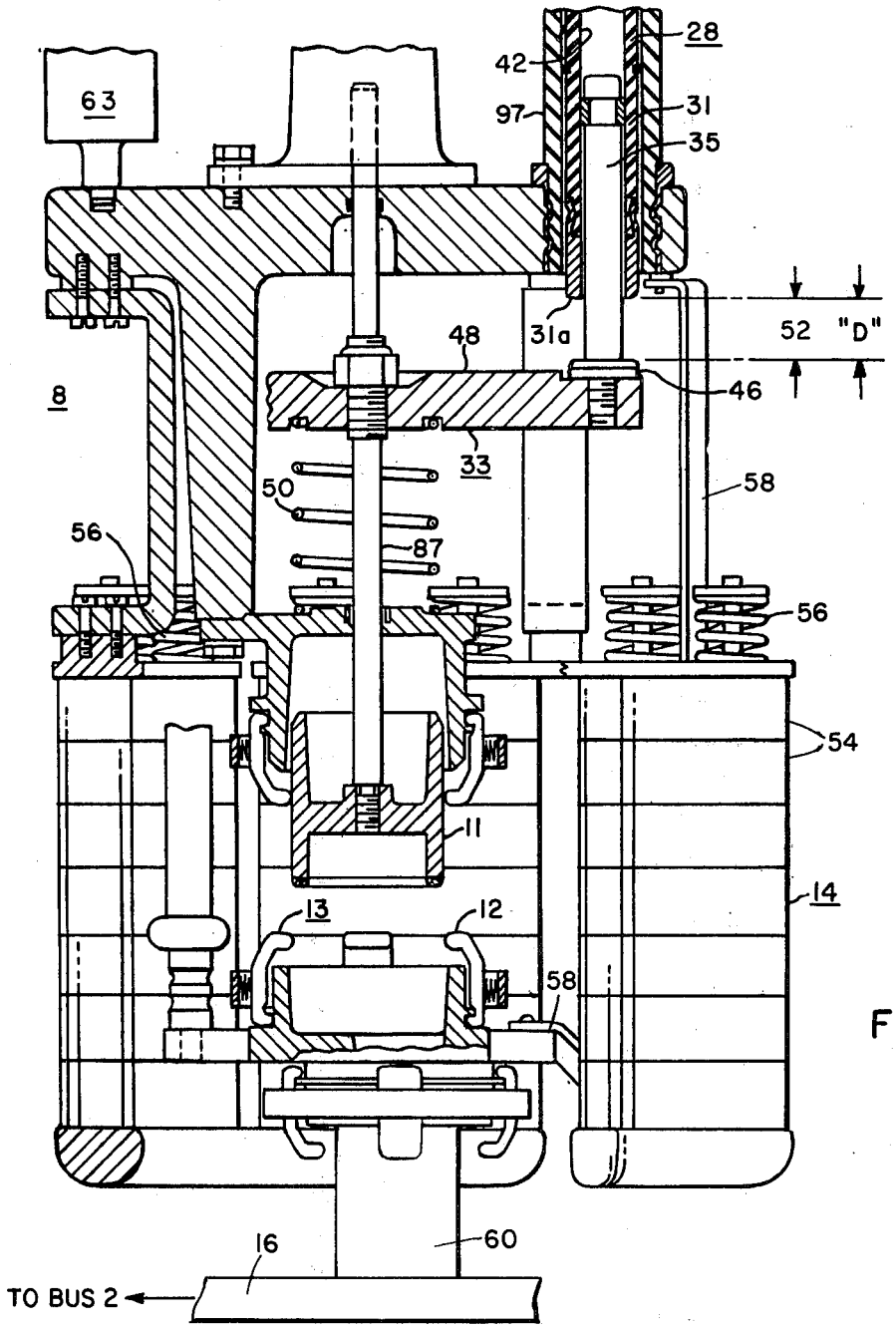
FIG. 8 is a view similar to FIG. 6C, but indicating the intermediate position of the separable resistance contacts during the opening operation, in which the main frame has pulled upwardly away from the lower resistance-frame, connected to the lower movable resistance contact structure, this FIG. 8 illustrating the lost-motion connection between the two frames, wherein the upper main frame has pulled away from the lower resistance-frame.
Figure 9:
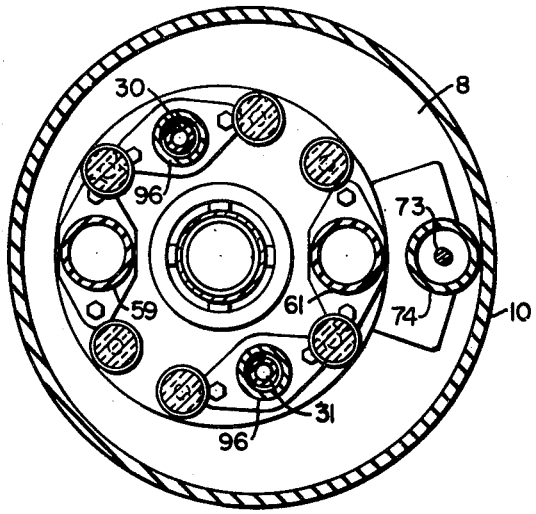
FIG. 9 is a sectional view taken substantially along line IX—IX of FIG. 4A.
Figure 10:
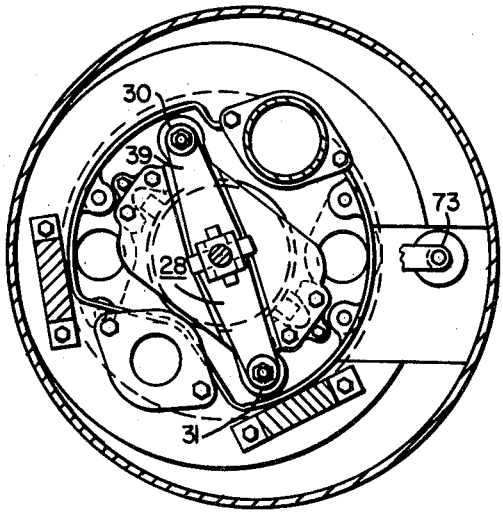
FIG. 10 is a sectional view taken substantially along the line X—X of FIG. 4A.

Disposed at the upper end of the columnar assemblage 3 of FIG. 4A is an operator, or driving mechanism 26, more fully illustrated in U.S. Pat. No. 3,590,189, issued June 29, 1971 to Fischer et al, and assigned to the assignee of the instant application. To understand the present invention, however, it is only necessary to know that downward movement of the operator, generally designated by the reference numeral 26 in FIG. 4A, effects closing downward operation of the contact structures 13, 21 and 22. Conversely, upward linear movement of the operator 26, together with the main frame assembly 28, comprising the operating rods 30, 31 of FIG. 5A, will cause opening movement of the main contact structures 21 and 22. It is an important feature of the present invention that there are two frame-assemblies 28, 33 utilized. The upper frame-assembly 28 includes a generally H-shaped structure including transverse bridging members 39, 40 together with a pair of downwardly-extending interconnecting movable operating rods 30, 31. The lower ends of the operating rods 30, 31 are hollow, as indicated at 42 in FIG. 6C, and make separable abutment connection at 44 with a resilient bumper 46, such as of rubber, affixed to and secured to a lower cross-member 48 attached to the lower frame-assembly 33 associated with the movable resistance contact 11, as illustrated in FIGS. 5C, 6C and 8 of the drawings.

Figure 5C:
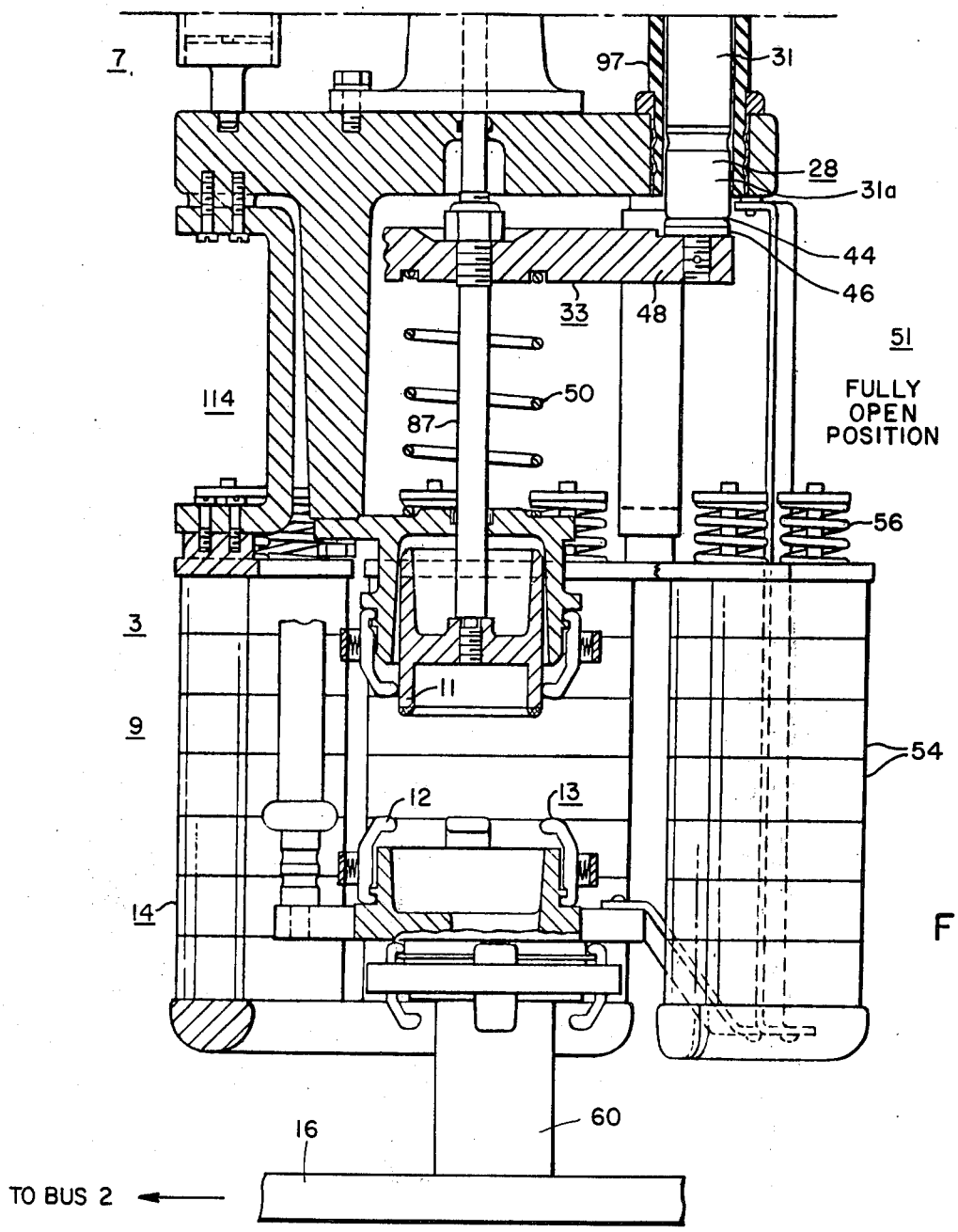
FIG. 5C is an enlarged vertical sectional view showing the lower separable resistance contacts with these contacts being shown in the fully-open-circuit position of the circuit-interrupter.
Figure 6A:
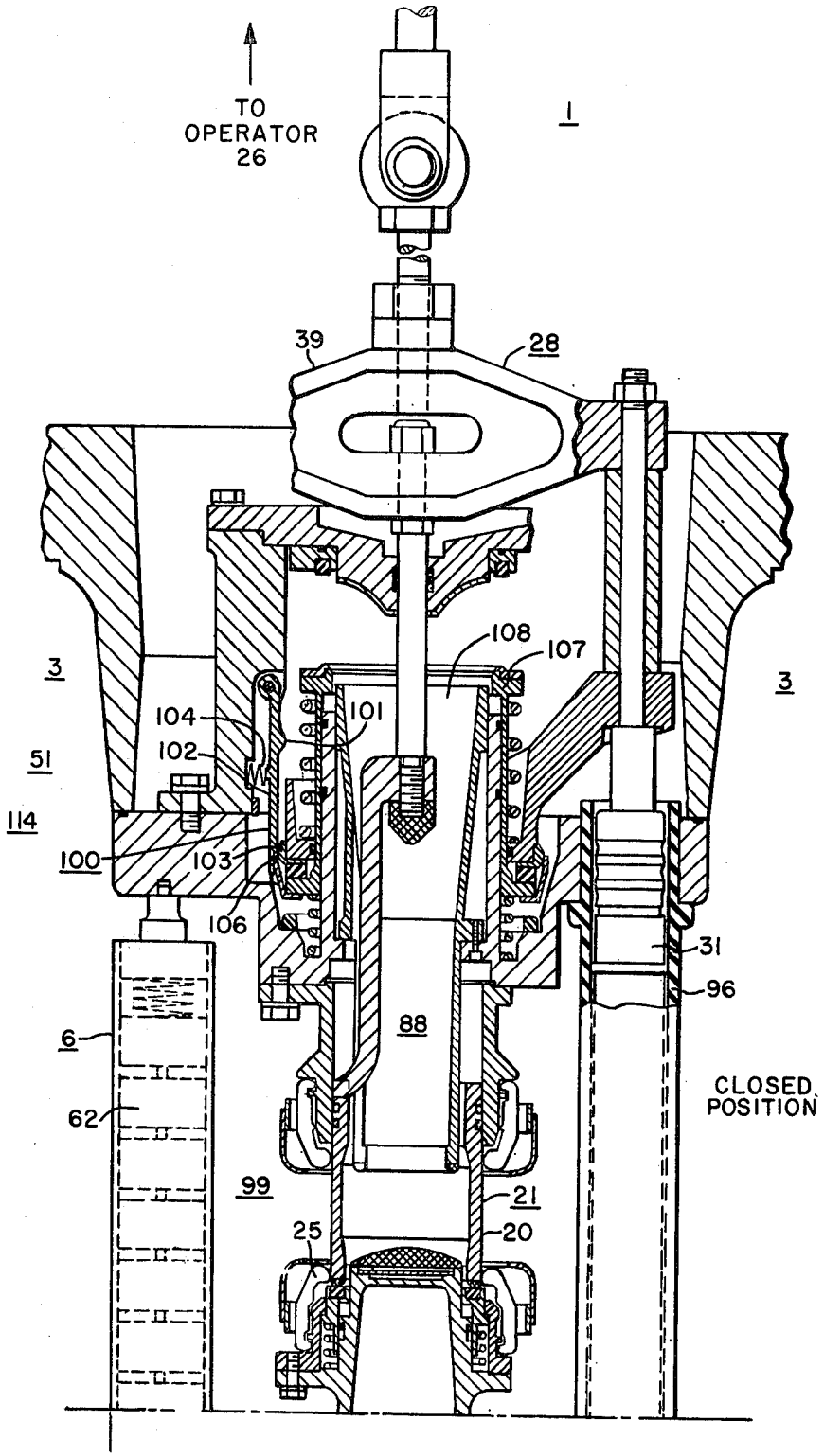
FIG. 6A is an enlarged vertical sectional view taken through the upper arc-extinguishing unit of the structure illustrated in FIG. 5, again with the contact structure being illustrated in the closed-circuit position.
Figure 6B:
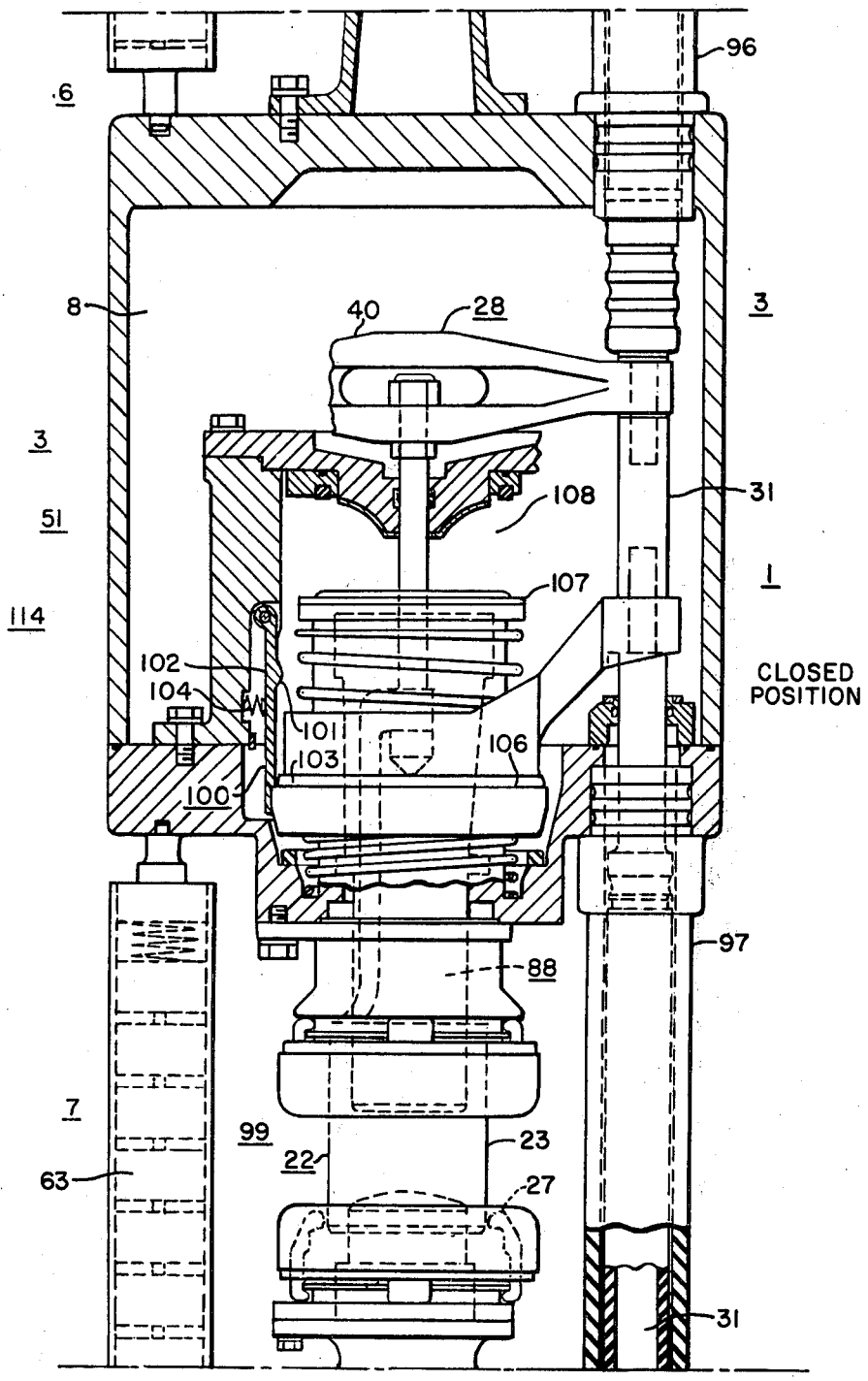
FIG. 6B is a generally vertical sectional view taken through the second main contact structure of the arc-extinguishing unit, disposed immediately below the upper arc-extinguishing unit, illustrated in FIG. 6A, again the contact structure being illustrated in the closed-circuit position.
Figure 6C:
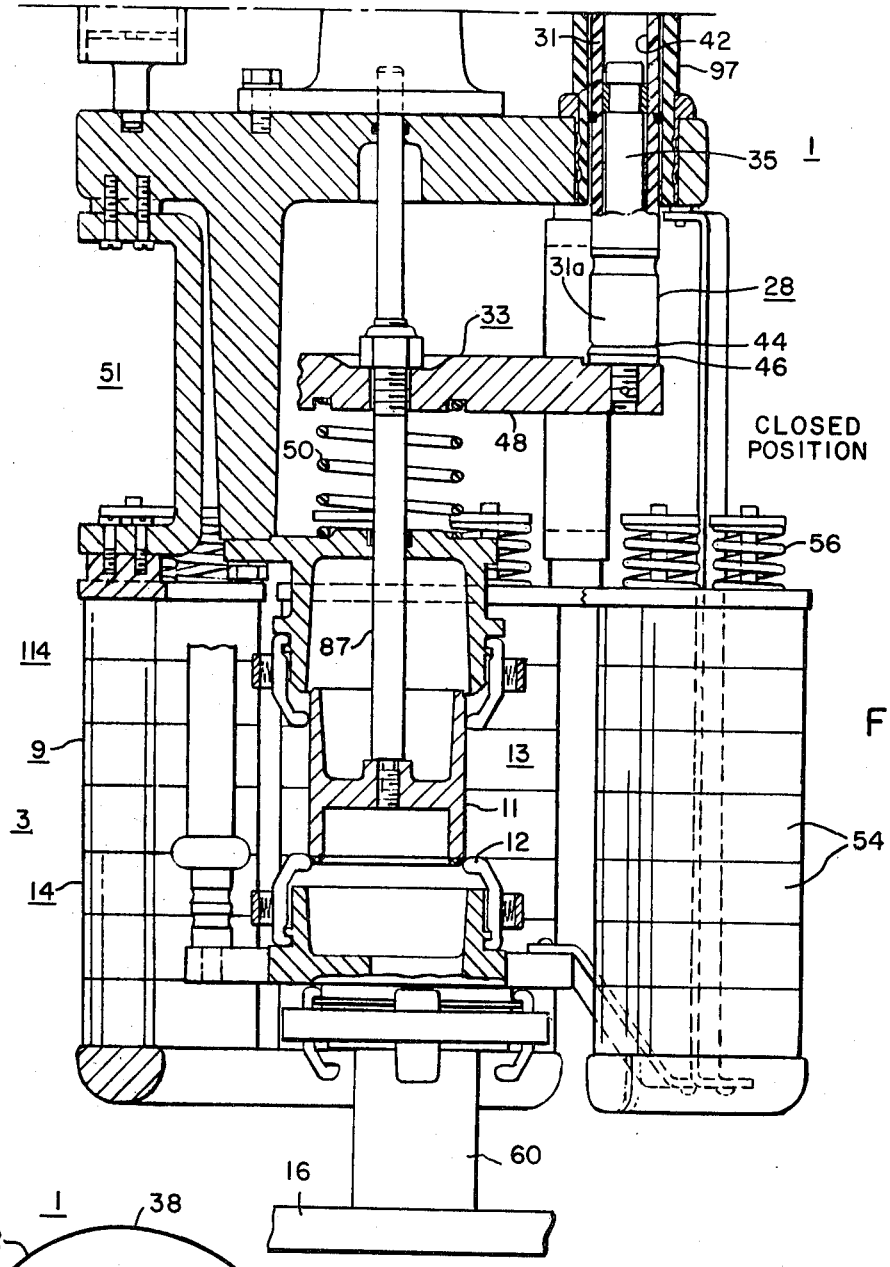
FIG. 6C is an enlarged vertical sectional view taken through the lower separable resistance contacts, the resistance contacts being illustrated in the closed-circuit position.
Figure 7:
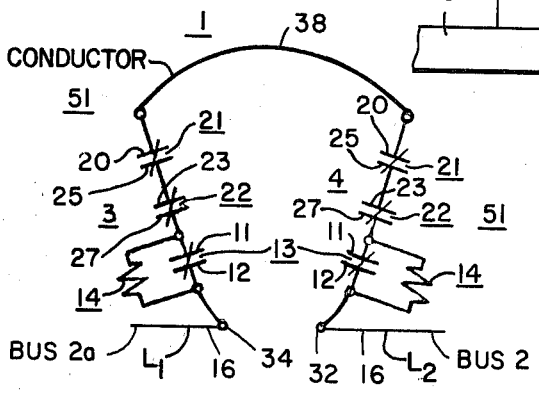
FIG. 7 is a diagrammatic view of the circuit illustrating the location and arrangement of the two main arc-extinguishing units for each side of the pole-unit, with an indication of the location of the closing-resistance contacts, and the relationship of the closing resistance relative to the separable resistance contacts, all of the contacts being illustrated in the closed-circuit position of the circuit-interrupter.

During the downward closing operation of the circuit-interrupter 1, it will be observed that the light spring 50, (FIG. 5C) maintains the two frame-members 28 and 33 in abutment, as at the separable connection 44 in FIG. 6C, so that the downward closing movement of the three contact structures 21, 22 and 13 is simultaneous. The overlap distance of the two main movable contacts 20, 23, relevant to their associated stationary contacts 25, 27, is such that they make contacting closing engagement before the closing engagement of the movable resistance contact 11 with its stationary resistance contact 12. This results in the closing resistance 14 being inserted into the circuit 16 prior to the subsequent closing of the resistance contacts 11 and 12 by roughly one-half cycle time duration. Thus, in the closed-circuit position, all of the three pairs of contacts are closed, but due to the contact overlap distance at the stationary main contacts 25, 27, the main separable movable contacts 20, 23 make contacting electrical engagement prior to the subsequent closing of the resistance contacts 11, 12 due to the physical dimensions of the contact members utilized.

In the closed-circuit position of the circuit-interrupter, as illustrated in FIGS. 6A, 6B and 6C, the circuit 16 is closed through the two columnar assemblages 3, 4, and the resistance 14 is out of the circuit, as caused by the closing of the shunting resistor contacts 11 and 12.

The shunting of the closing resistance 14 is, of course, desirable as well appreciated by those skilled in the art, inasmuch as it would lead to heating and energy losses in the closed-circuit position of the interrupter 1. Its use during the closing operation is to avoid the occurrence of high-voltage surges occurring on the line 16 during a closing operation. The theory and functioning of a closing resistance of the proper value is, of course, set forth in the aforesaid Van Sickle U.S. Pat. No. 3,291,947, to which reference has been made and the subject matter of which is incorporated herein by reference.

During the opening operation, it is, of course, desirable for the erosion and burning associated with the extinguishing of the arcs 18, 19 to occur only at the main two contact assemblages 21, 22 in the upper portion of each columnar arc-extinguishing assemblage 3, 4. The arrangement is such that the inertia of the lower resistance frame-assembly 33 is such that it "hangs" behind, or there is a lost-motion connection 52 FIG. 8 between the two-frame assemblages 28 and 33 due to the inertia of the lower resistance frame-assemblage 33 and the relatively light biasing spring 50 of FIG. 6C. The net result is that the operator 26 has sufficient opening driving force to quickly and rapidly accelerate the upper frame-assembly 28, together with its associated two moving main contacts 20, 23, upwardly to break the circuit 16 at these two points, whereas the resistance contacts 11, 12 are yet closed, there-by shorting out the lower closing resistance 14, and thus imposing all arcing 18, 19 upon the upper two serially-related main arc-extinguishing structures 6, 7.

By the time that the relatively light spring 50 of FIG. 6C raises the lower movable resistance frame assembly 33 to effect contact break at the resistance contacts 11 and 12, at this time arcing 18, 19 in the upper two serially-related units 6, 7 has ceased, arcing is out and thus there is no arc erosion or burning occurring at the lower separable resistance contacts 11 and 12.

Figure 11:
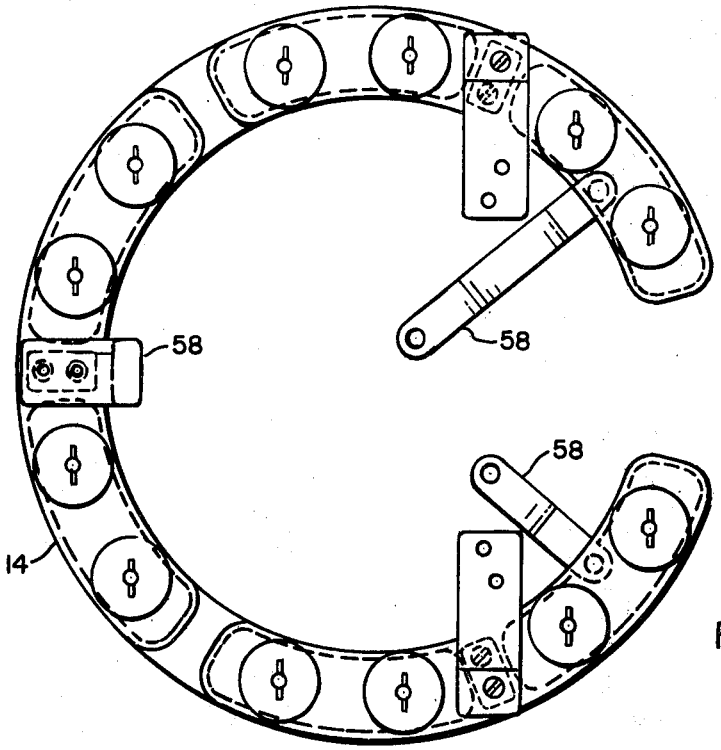
FIG. 11 is a top plan view of the closing-resistance assemblage of FIG. 12.
Figure 12:
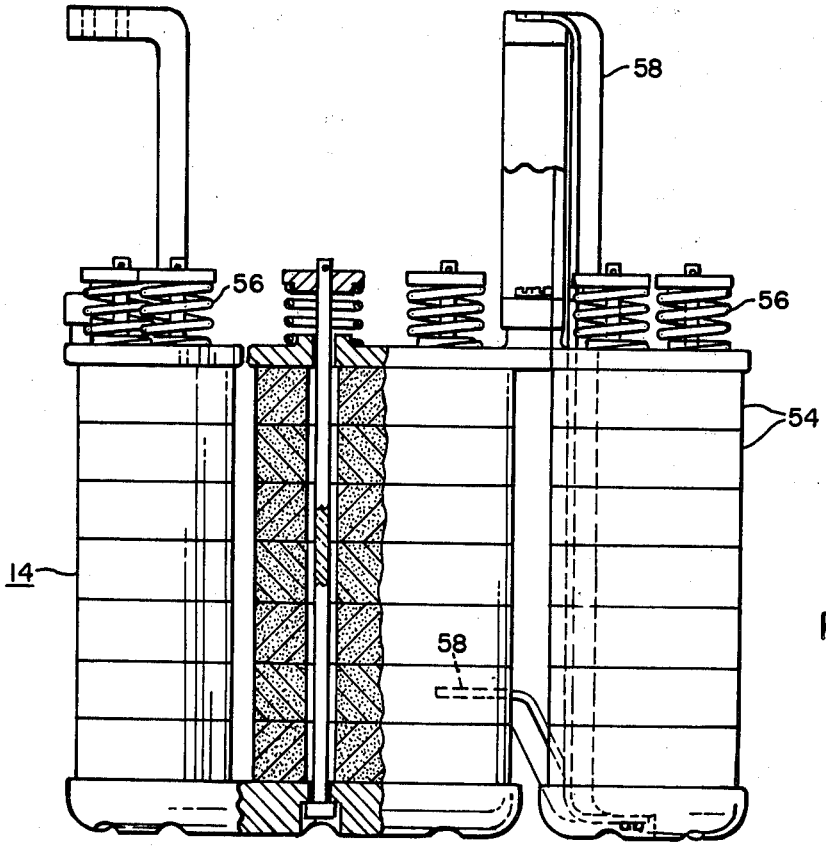
FIG. 12 is a generally side elevational view of the closing-resistance assemblage.

The closing resistance assemblage 14 is more clearly set forth in FIGS. 11 and 12, where it will be observed that the carbon arcuate segments 54 are in compression, as caused by the compression springs 56, and connections 58 between the carbon resistance segments cause the resistance assemblage 14 to be of the right ohmic value, as set forth in the aforesaid Van Sickle U.S. Pat. No. 3,291,947.

With reference to the lower end of the columnar assemblage 3, it will be observed that there is a lower contact portion 60, which is connected to the line terminal $L_1$.

Figure 17:
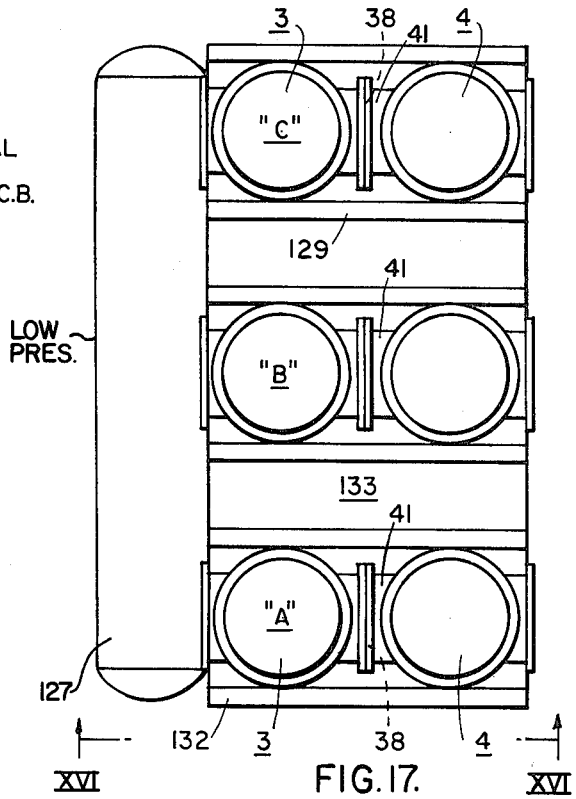
FIG. 17 is a top plan view of the circuit-breaker assemblage of FIG. 16, showing, in more detail, the modified-construction of the low-pressure gas reservoir tank; and, FIG. 18 illustrates a modified form of the invention in which the two arc-extinguishing assemblages are disposed in a generally horizontal arrangement, instead of a vertical arrangement, with the gas and mechanism housing structure disposed lengthwise along one of the two arc-extinguishing assemblages.

Although the above description has been centered around one columnar assemblage 3, it will be noted that the same description is appropriate for the other laterally spaced upstanding columnar arc-extinguishing assemblage 4, which has a generally identical construction and function. As a result, there are four main separable contact structures in each pole-unit "A", "B", or "C", as shown in FIG. 17. The function of these four main contact structures is to interrupt the electrical current flow through the pole-unit "A" during the opening operation, and the four separable main contact structures distribute the arcing 18, 19, and voltage division among the four series breaks is controlled by shunting capacitor branches paralleling the interrupting assemblages. These are designated by the reference numerals 62 and 63 of FIGS. 6A and 4B.

It is to be further noted that in each pole-unit "A", "B", or "C" there is provided the two closing resistances 14 together with their associated separable resistance contact assemblages 13, which function, during the opening operation, to keep the resistances 14 out of the circuit 16 during the interruption process. During the closing operation of the interrupter 1, on the other hand, the main contact structures 21, 22 are closed, whereas the separable resistance contacts 11, 12 are still open, so that the two resistances 14 are serially inserted into the circuit 16 during the closing operation to prevent high-voltage surges occurring on the line 16.

As set forth in FIG. 3, a main operating mechanism 64 at ground potential, which is described in U.S. Pat. No. 3,624,329, which issued Nov. 30, 1971 to Fischer et al, effects rightward movement of a connecting rod 68, which effects counterclockwise rotation of two bell-crank levers 70, 71, each of which has an upstanding movable valve-rod 73 (FIG. 9) pivotally connected thereto at 75. The two bell-crank levers 70, 71 are pivotally mounted on stationary pivots 77, 78. Pivotally connected at 86 to the right-hand bell-crank lever 71 is the upstanding valve-rod 73 associated with the right-hand column 4 of the pole unit "A". Clockwise pivotal rotation of the driving rod 68 effects upward movement of the two valve-rods 73, which serve to pneumatically cause pressure to occur on the bottom side of an operating piston (not shown) constituting a part of the upper operator 26 illustrated in FIG. 4A of the drawings.

The operator 26 is set forth and described in U.S. Pat. No. 3,590,189, and during the closing operation, as described hereinbefore, causes downward movement of the H-shaped frame 28 comprising the two operating rods 30, 31 movable within stationary guide sleeves, or tubes 96, 97, and serving to simultaneously cause the downward closing movement of the two main movable contacts 20, 23 in each assemblages 3, 4.

As set forth in U.S. Pat. No. 3,596,028, a latching arrangement 100 (FIG. 6A) is associated with each main movable contact 20 or 23, as disclosed more clearly in FIG. 5B of the drawings. It will be observed that there are provided a pair of pivotally-mounted latches 102 biased radially inwardly by a pair of compression springs 104, only one latch assembly 102 being viewed in FIG. 5B of the drawings. The construction is such that during the closed position, as viewed in FIG. 6A, the latches set upon shoulder portions 106 associated with the secondary blast-valves 107, which, when open, permits gas flow to occur out ports 108 associated with the rear side of the upper movable main contact 20, as viewed in FIG. 5A. This gas-flow action is described in more detail in U.S. Pat. No. 3,596,028 to which reference may be made, and the subject matter of which is incorporated herein by reference.

Figure 5A:
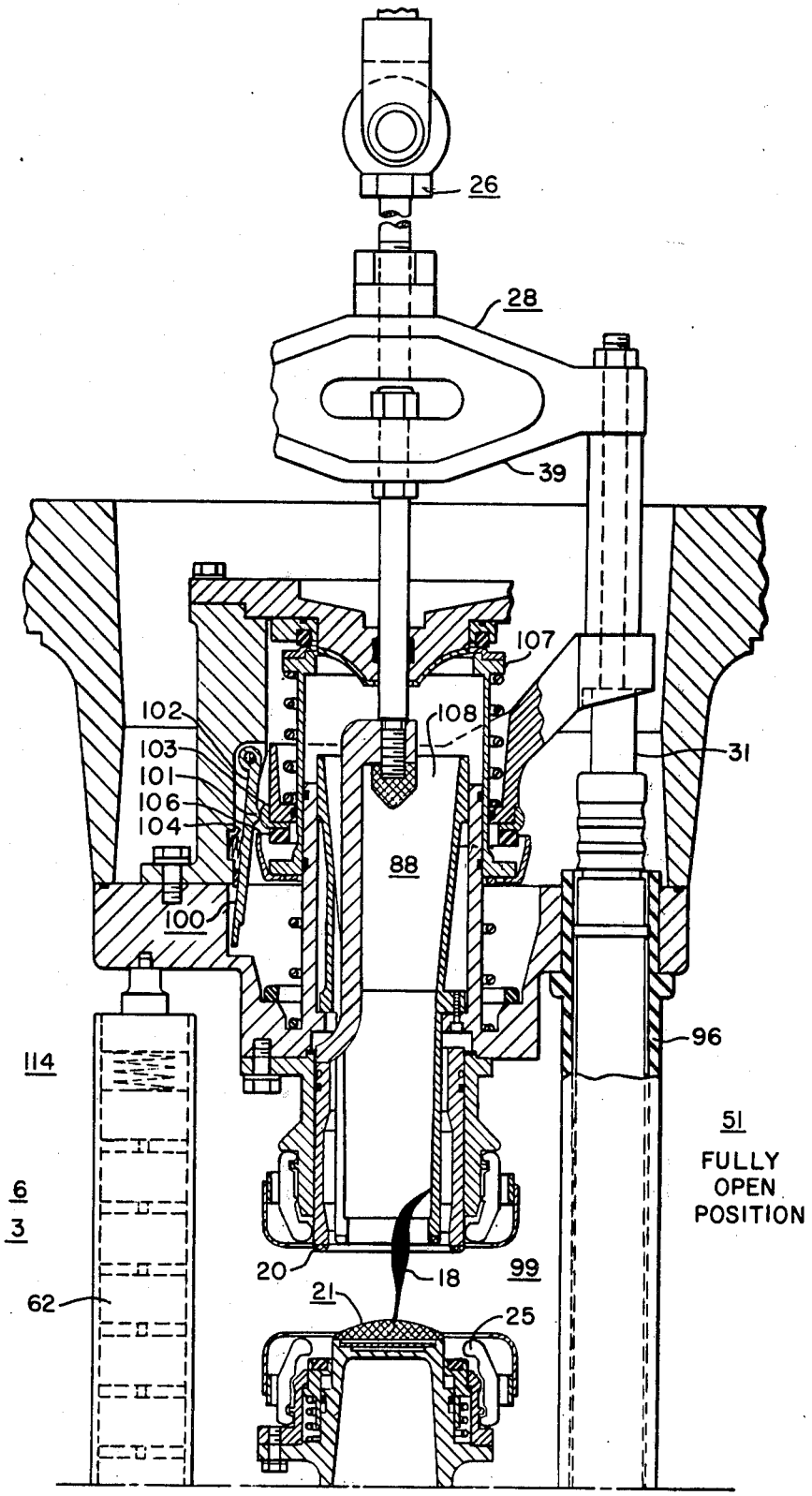
FIG. 5A is a vertical sectional view of the upper main contact structure for the upper main arc-extinguishing unit, the illustration showing the separable main contacts in the fully-open-circuit position.
Figure 5B:
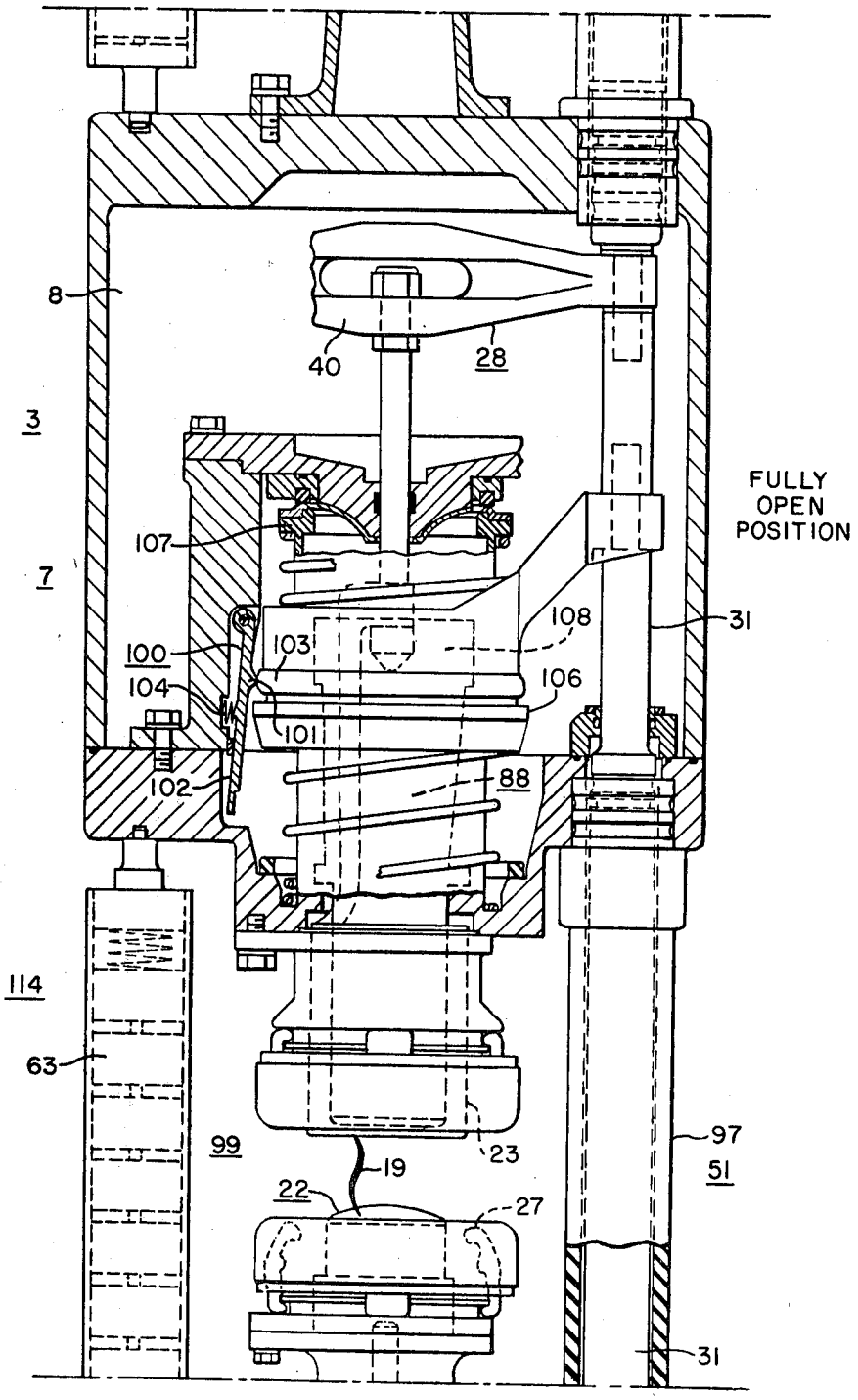
FIG. 5B is a fragmentary enlarged view of the lowermost main contact structure showing the latter in the fully-open-circuit position. It will be noted that this extinguishing structure is in series with the upper main contact structure shown in FIG. 5A.

Following a predetermined opening motion of the movable contact structure 20 to 23, a portion 103 of the movable contact structure bears on a cam portion 101 of the latches 102, forcing the latches 102 outwardly to thereby release the blast-valves 107, which move upwardly to the closed position, thereby halting any gas flow out of the interrupting chamber 88 (FIG. 5A) in the open position of the main contacts, as illustrated in FIGS. 5A and 5B of the drawings. It will be noted that there exists at all times high-pressure gas within the region externally of the main contact structure, as designated by the reference numeral 99 in FIG. 5B of the drawings. This high-pressure gas is available immediately upon separation of the contacts to effect extinction of the arcs 18, 19, which are indicated in FIG. 5, although the contact structure in illustrated in the fully-open position in FIGS. 5A and 5B of the drawings.

FIGS. 5B and 6B show more clearly the mechanical interconnection of the movable main contact 23 of the lower-most main arc-extinguishing structure 7. It will be observed that a cross-member 40 is mechanically interconnected between the two operating rods 30, 31, and serves somewhat the same function as the upper traverse member 39 of FIGS. 6A and 7A. As mentioned hereinabove, the two main operating rods 30, 31 have lower hollow extensions 42 which encompass movable projections 35 affixed to the lower movable traverse frame-member 48 of the resistance assemblage 33, as indicated more clearly in FIGS. 6C and 8 of the drawings. The lost-motion between the lower hollow tubular extensions **30*a*, 31*a* of the two main operating rods 30, 31 and the resilient rubber bumpers 46, affixed to the resistance traverse member, is designated by the reference numeral 52 in FIG. 8, and the distance at this particular point of time is designated by the distance length "D" in FIG. 8 of the drawings. Consequently, FIG. 8 illustrates a point in time during the opening operation of the interrupter 1 in which the main movable resistance contact 11 has lagged behind to short out the closing resistor 14, while the upper two breaks 21, 22 are causing the extinction of the arcs 18, 19 within the interruptor 3**.

Also associated with each columnar assemblage 3, 4 is an outer cylindrical insulating casing member 10, which holds the high-pressure gas 8 within the regions 99 externally of the two main contact structures 21, 22. Also, it will be noted that externally of the insulating casing member 10 is disposed an outer metallic grounded casing 15 utilized for its ground characteristics. The line connection $L_1$ is secured to a terminal structure 34 more clearly shown in FIG. 3, which electrically connects the circuit 16 to the lower resistance contact 12. As set forth in the aforesaid Kane et al U.S. Pat. No. 3,596,028, the circuit 16 extends through both columnar assemblages 3, 4 and terminates at the lower end 32 of the other assemblages 4 of FIG. 3.

From the foregoing description it will be apparent that a novel arrangement has been provided, in connection with a closing resistance 14 and associated separable resistance contact structure 13, controlling the insertion of the closing resistance 14 into the circuit 16 only during the closing operation of the breaker 1. During the opening operation of the breaker, the closing resistance 14 is deliberately shorted out of the circuit 16, so that the full burden of arc-extinction 18, 19 is imposed only on the upper two main separable contact structures 21, 22, and no arcing occurs at the separable resistance contacts 11, 12. The inertia of the resistance frame 33 and the relatively light spring 50 are thus utilized to afford the desirable delaying, or lost-motion effect 52 for the lower resistance frame-member 33.

Suitable mechanical support tubes 96, 97 are provided to fixedly maintain the stationary contact structures 25, 27 in the desired stationary location, and to provide mechanical integrity of the arc-extinguishing assemblage 3 as a whole.

With reference to FIG. 3 it will be observed that a low-pressure tank 29 is provided together with compressor equipment, as set forth in U.S. Pat. No. 3,596,028.

The manner of arc-extinction and the operation of the various parts is also more clearly set forth in the aforesaid U.S. Pat. No. 3,596,028.

This resistor contacts 11, 12 are for use in a high voltage power circuit breaker rated at 362 kV. The breaker is capable of 40 kA interrupting ability and carrying 3000 Amps continuously. The pre-insertion resistors 14 are available from 175 ohms to 300 ohms each. There are two of these per phase. They are electrically and thermally capable of closing into a full fault four times each hour. The movable contact 11 shorts out the resistor 14 from 6 to 9 milliseconds after it has been inserted into the circuit. The use of a closing resistor optimally sized for each system reduces the overvoltages caused by closing the circuit breaker into a transmission line with a trapped charge, and subsequently reduces the electrical stress imposed on the entire power system's equipment. This stress is reduced to a maximum of 2.0 times the normal line to ground voltage whereas this maximum is 3.0 times the normal line to ground voltage when no closing resistor is used.

Figure 13:
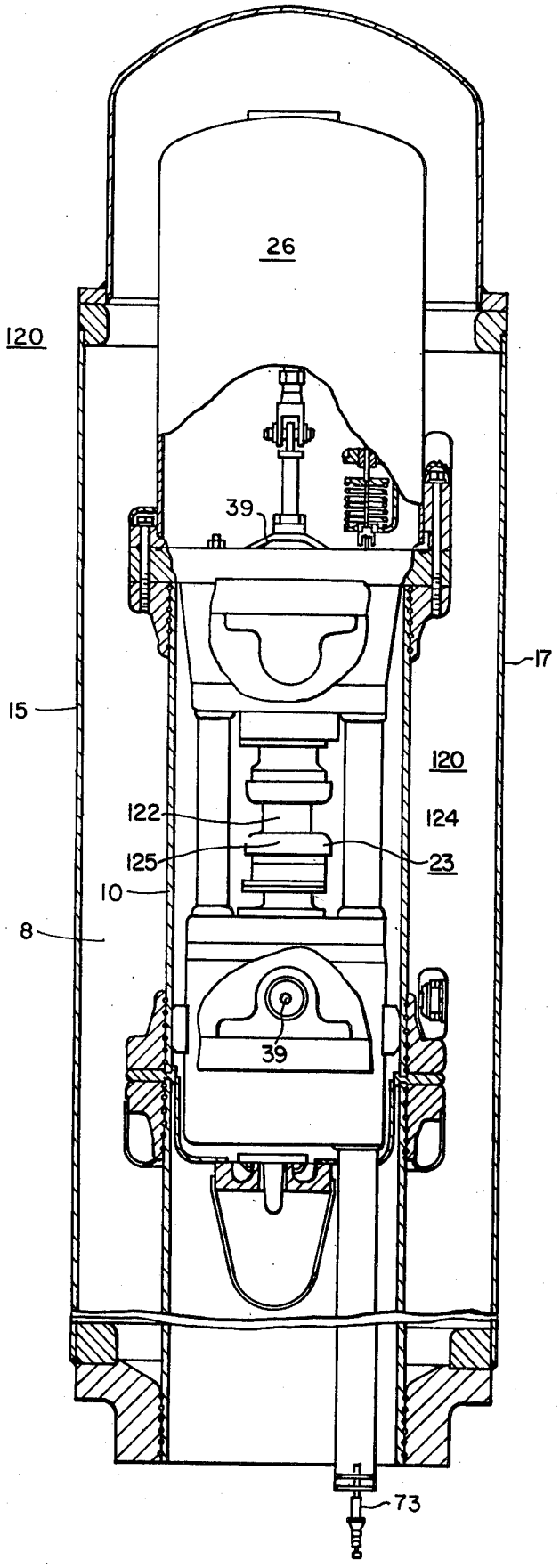
FIG. 13 is a vertical sectional view of a modified-type of circuit-interrupter module for the lower-current ratings, involving only one break for each upstanding circuit-breaker assembly, the contacts being shown closed.
Figures 14, 15:
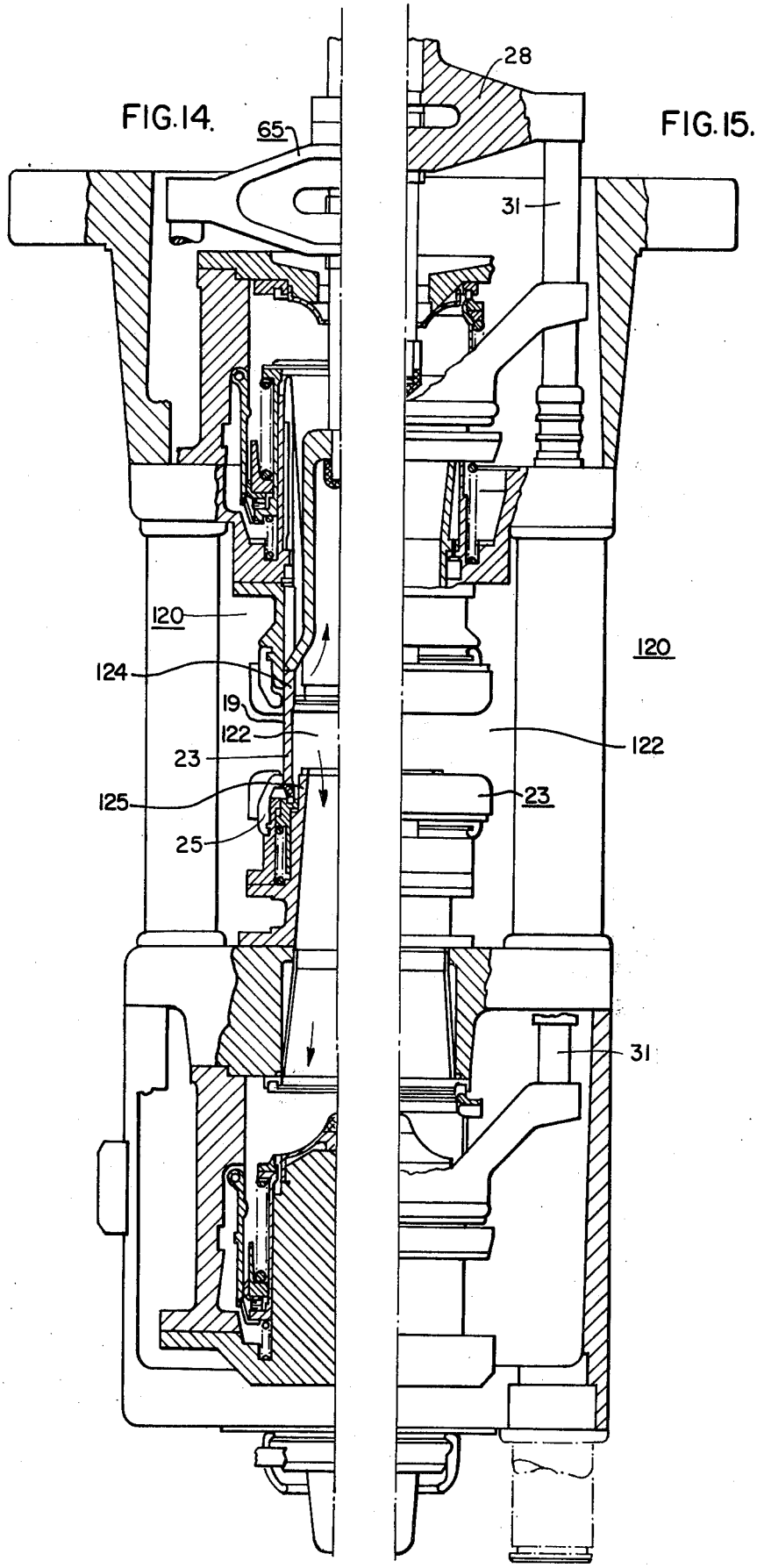
FIG. 14 is a fragmentary vertical sectional view illustrating the lower-rating circuit-breaker module of FIG. 13, with the contacts being shown in the closed-circuit position.
FIG. 15 is the circuit-breaker module of FIG. 14 with the contacts being shown in the open-circuit position.

For the lower-voltage and power ratings, where closing voltage surges are not a problem, a modified-type of circuit-breaker module 120 may be employed, such as set forth in FIGS. 13–15 or the drawings. The modified-type of circuit breaker module 120 includes only a single break 122, having a double-flow through the moving contact structure 124 and also through the stationary contact structure 125, as illustrated more clearly in FIG. 15 of the drawings. The manner of operation is the same as set forth in the higher-rating circuit-breaker module 51, hereinbefore discussed in connection with FIGS. 3–12 of the drawings.

FIGS. 14 and 15 show the closed and fully-open circuit positions of the modified circuit-breaker module 120, and it is, as mentioned, used for the lower ratings without a resistance 14.

Figure 16:
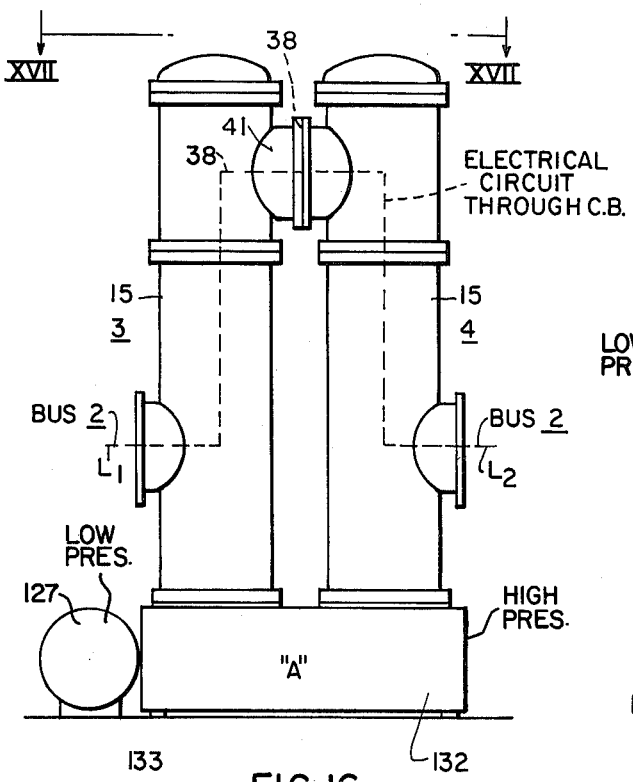
FIG. 16 is a side-elevational view of a modified-type of interrupting assemblage configuration, with the low-pressure reservoir tanks relocated.

FIGS. 16 and 17 show a modified-type of mounting construction 133 in which the position of the low-pressure reservoir tank 127 is removed to a side-lateral position, straddling the lower three frame-support members 129–131 for the three phases of the installation 132. The other features of the circuit-breaker construction 132 of FIGS. 16 and 17 are the same as heretofore described.

It will be observed that the improved construction of the present invention involves improved mounting support features, such as the pressurized tubes 49 (FIG. 3) not only supporting the circuit-breaker modules 51, but, additionally, providing high-pressure gas-flow to the pressurized casing structure 10 disposed at the upper end of each of the two interconnected circuit-breaker assemblages 3, 4. Additionally, the operating rods 73 for controlling the control-valves are passed through the exhaust tubes 74, which carry the low-pressure gas, following an interrupting operation, down to the low-pressure reservoir tanks 29. As will be obvious, a suitable gas compressor equipment, not shown, takes the gas at the lower pressure level, as supplied in low-pressure reservoir tank 29, and compresses it to the high-pressure level, such as 240 psig, and provides it in through the conduit, or pipe 55 into the two pressurized insulating casings 49, 10.

From the foregoing description, it will be apparent that there has been provided an improved circuit-breaker installation 1, 120 adaptable for metal-clad switchgear, and accommodating a wide variety of ratings. For the very high-power ratings, with high-voltages, where the possibility of closing voltage surges may be encountered, the circuit-breaker module 51, with a number of breaks and closing breaks, such as set forth in FIGS. 3–12, may be utilized. However, for the lower-voltage ratings, where voltage surges are not a problem, then a more simplified-type of interrupter 120 having single or double-flow conditions, as desired, may be supplied, as set forth in FIGS. 13–15.

Figure 18:
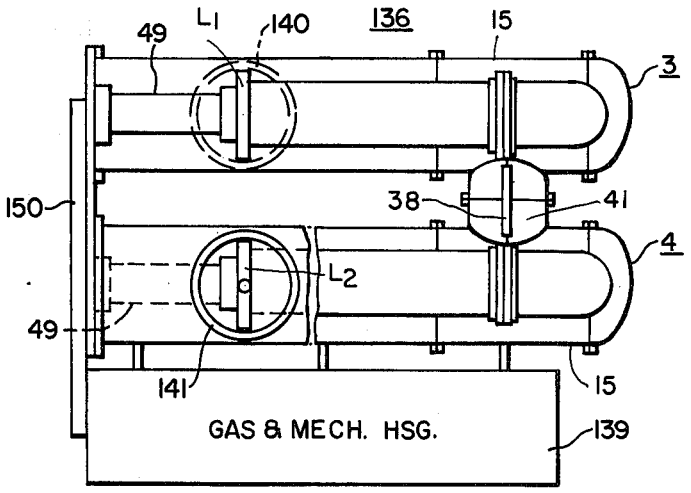

According to an alternate mounting arrangement 136 of the present invention, as set forth in FIG. 18 of the drawings, a horizontally-arranged construction is provided. As shown in FIG. 18, it will be observed that instead of the circuit-interrupting assemblages 3, 4 extending up in the air, the modified-type of construction 136, as set forth in FIG. 18, the circuit-breaker assemblages 3, 4 are mounted horizontally and close to the ground, with the gas-and-mechanism housing 139 provided longitudinally therealong also horizontally arranged. FIG. 18 shows the gas-and-mechanism housing 139 in close horizontal proximity to one of the two circuit-interrupting assemblages 4, as shown. The high-pressure supporting-tube construction 49 is the same as set forth hereinbefore, but, as set forth in FIG. 18, the terminal connections are somewhat modified, and extend vertically, as indicated by the reference numerals 140, 141 in FIG. 18. The operation of the interrupter modules 6, 7 is the same as herebefore described in connection with FIGS. 3–12 of the drawings.

The high-pressure connection 150 extends between the two pressurized support tubes 49 to the mechanism housing 139, where a suitable compressor equipment is provided. Additionally, an operating mechanism is provided to effect reciprocal horizontal operation of the control-valves 73, as heretofore described. The interconnecting linkage is somewhat diagrammatically illustrated by the reference numeral 150 of FIG. 18, but it will be obvious to those skilled in the art that suitable modifications may readily be made.

Although there have been illustrated and described specific structures, it is to be clearly understood that the same were merely for the purpose of illustration, and that changes and modifications may readily be made therein by those skilled in the art, without departing from the spirit and scope of the invention.

We claim:

1. A high-power, high-voltage metalclad compressed-gas circuit-interruptor structure including two laterally-spaced-apart metalclad circuit-breaker assemblages (3, 4), at least one circuit-breaker unit (8, or 9) having a pair of separable contacts (23, 25) disposed interiorly within each metalclad circuit-breaker assemblage (3, 4), each metalclad circuit-breaker assemblage (3, 4) having an outer-disposed metallic casing (15), an interiorly-disposed supporting insulating high-pressure gas-containing tube structure (49) at least partially supporting each circuit-breaker unit (8 or 9) in spaced radial inward fixed relationship away from the outer metallic grounded casing (15), pressurized interconnecting metallic gas-conducting means (41) disposed adjacent one end of the two laterally-spaced-apart metalclad circuit-breaker assemblages (3, 4) and pneumatically interconnecting the gas spaces therein (24) about the circuit-breaker units (8 or 9), an electrical connection (38) disposed centrally within said interconnecting metallic gas-conduit means (41) and electrically interconnecting said circuit-breaker assemblages (3, 4) in electrical series relationship for interrupting high-voltage circuits, a presurrized terminal (16) within a metalclad casing structure (2) connecting to each metalclad circuit-breaker assemblage (3, 4) adjacent the mid-portion thereof, a high voltage power conductor in each said latter-mentioned pressurized terminal metalclad casing structure (2), a grounded metallic supporting frame structure for at least partially supporting said circuit-breaker assemblages (3, 4), at least one gas-reservoir tank also at least supported by said metallic frame structure for storing arc-extinguishing gas, and operating means at high voltage disposed adjacent said one end of the two-laterally-spaced-apart circuit-breaker assemblages (3, 4) comprising two high-voltage operators (26) for simultaneously actuating the two circuit-breaker assemblages (3, 4) in their opening and closing movements.

2. The high-power, high-voltage metalclad compressed-gas circuit-interrupter structure of claim 1, wherein a plurality of pairs of series contacts are disposed within each circuit-breaker assemblages (3, 4), one of said pairs of contacts constitutes a separable resistance pair of contacts which is normally shunted by a closing resistance, means for inserting said closing resistance during the closing operation of the circuit-interruptor structure (3 or 4), and means for preventing the insertion of said closing resistance during the opening operation of the circuit-interruptor structure.

3. The combination according to claim 1, wherein the two laterally-spaced-apart metalclad circuit-breaker assemblages (3, 4) extend vertically upwardly in the air, and said gas-conduit means (41) is disposed a considerable elevational distance above ground potential.

4. The combination according to claim 1, wherein the operating means at high voltage is pneumatic and controls the opening and closing movements of a pair of piston members, and one piston member being associated with each circuit-interrupting assemblages (3, 4).

5. The combination according to claim 3, wherein the high-voltage operating means in pneumatic in character and includes a pair of vertically-movable contact-operating piston members, and one piston member being associated with each circuit-interrupting assemblage (3, 4).

6. The combination according to claim 3, wherein each high-voltage operator (26) includes an actuating piston and a control valve, and longitudinally-upstanding control-valve rod extending interiorly within each of the two grounded metallic casing structures (3, 4) for actuation of the control valve within each high-voltage pneumatic operator (26), whereby vertical movement of said control-valve rod will effect actuation of the control valve in each high-voltage operator (26) to thereby admit high-pressure gas to said actuating piston structure and thereby effect opening separating motion of the separable contacts within each of the circuit-interrupting units (8 or 9).

7. The combination according to claim 6, wherein the vertically-movable control-valve rod (73) moves within a hollow tube structure (74), and the latter additionally provides and exhaust passage for low-pressure gas to exhaust from the circuit-interrupting units (8, 9) down to the lower grounded frame structure and into the said gas-reservoir tank.

8. The combination according to claim 2, wherein each of the circuit-interrupting units (6, 7) comprises at least one interrupting set of contacts and a separable series resistance set of contacts, and a shunting resistance is electrically connected around each set of separable resistance contacts, whereby voltage surges may be minimized during the closing operation of the circuit-interrupter structure.

9. The combination according to claim 1, wherein each circuit-interrupting unit (8, 9) comprises a single set of interrupting contacts, said pneumatic operator (26) at high voltage effects actuation of said separable set of interrupting contacts, said high-voltage pneumatic operator (26) including a piston structure and a three-way control valve, and operating-rod means extending interiorly of the outer grounded casing structure for actuating said three-way control-valve.

10. The combination according to claim 1, wherein the annular space (24) around each of the circuit-interrupting units 6, 7 interiorly of the outer grounded metallic casing structure (15) is at one pressure-level, and the circuit-interrupting unit (8, 9) utilizes gas at two other pressure-levels, namely a high-pressure level for blasting and extinguishing the arc, and a lower-pressure level to which the gas exhausts following the interrupting operation.

11. The combination according to claim 6, wherein the low-pressure gas passes downwardly interiorly of each outer grounded metallic casing structure (15) through a hollow tube structure (74), said hollow tube structure (74) surrounding the vertically-movable valve-control rod (73) for each circuit-interrupting assemblage (3, 4).

12. The combination according to claim 1, wherein said gas-resevoir tank contains a highly-effecient arc-extinguishing gas at relatively low pressure.

13. The combination according to claim 1, wherein a gas-and-mechanism housing is provided and includes compressor equipment which is utilized to compress relatively low-pressure exhausted gas and to store it within said two high-pressure support tubes (49).

* * * * *